US008785090B2

(12) United States Patent
Yamano et al.

(10) Patent No.: US 8,785,090 B2
(45) Date of Patent: Jul. 22, 2014

(54) ELECTROPHOTOGRAPHIC PHOTORECEPTOR, PROCESS CARTRIDGE, AND IMAGE FORMING APPARATUS

(71) Applicant: Fuji Xerox Co., Ltd., Tokyo (JP)

(72) Inventors: Yuko Yamano, Kanagawa (JP); Shinya Yamamoto, Kanagawa (JP); Masahiro Iwasaki, Kanagawa (JP); Takayuki Yamashita, Kanagawa (JP); Yohei Saito, Kanagawa (JP); Jiro Korenaga, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/676,627

(22) Filed: Nov. 14, 2012

(65) Prior Publication Data

US 2013/0288169 A1 Oct. 31, 2013

(30) Foreign Application Priority Data

Apr. 27, 2012 (JP) ..... 2012-103988

(51) Int. Cl.
*G03G 5/00* (2006.01)
*G03G 5/06* (2006.01)

(52) U.S. Cl.
CPC ..... *G03G 5/0605* (2013.01); *G03G 5/0672* (2013.01); *G03G 5/0614* (2013.01); *G03G 5/0607* (2013.01); *G03G 5/0696* (2013.01)
USPC ..... 430/58.35; 430/58.8; 430/58.85; 399/159

(58) Field of Classification Search
USPC ..... 430/58.35, 58.8, 58.85; 399/159
See application file for complete search history.

(56) References Cited

U.S. PATENT DOCUMENTS

| | | | | |
|---|---|---|---|---|
| 5,910,610 | A | 6/1999 | Kobayashi et al. | |
| 5,989,765 | A | 11/1999 | Kobayashi et al. | |
| 6,172,264 | B1 | 1/2001 | Kobayashi et al. | |
| 2005/0164106 | A1 | 7/2005 | Bender et al. | |
| 2008/0305417 | A1 * | 12/2008 | Sugimura et al. | 430/58.85 |

FOREIGN PATENT DOCUMENTS

| | | |
|---|---|---|
| JP | A-6-123981 | 5/1994 |
| JP | A-8-295655 | 11/1996 |
| JP | A-2005-215677 | 8/2005 |
| JP | A-2008-15208 | 1/2008 |

* cited by examiner

*Primary Examiner* — Mark A Chapman
(74) *Attorney, Agent, or Firm* — Oliff PLC

(57) ABSTRACT

An electrophotographic photoreceptor includes a conductive substrate; and a single-layer photosensitive layer that is provided on the conductive substrate and includes a binder resin, at least one kind of charge generation material selected from hydroxygallium phthalocyanine pigments and chlorogallium phthalocyanine pigments, a hole transport material represented by Formula (1), and an electron transport material represented by Formula (2):

Formula (1)

-continued
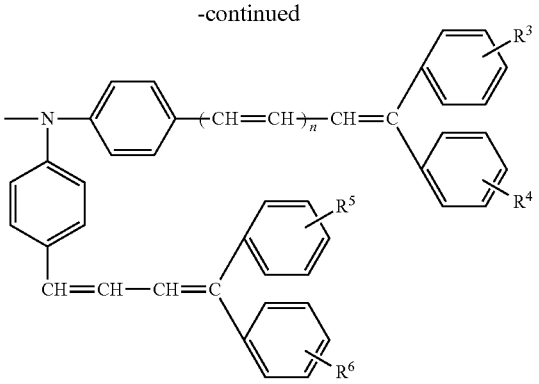
-continued
Formula (2)
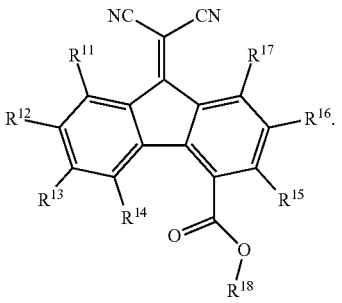
13 Claims, 3 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-103988 filed Apr. 27, 2012.

BACKGROUND

1. Technical Field

The present invention relates to an electrophotographic photoreceptor, a process cartridge, and an image forming apparatus.

2. Related Art

In electrophotographic image forming apparatuses of the related art, a toner image, formed on a surface of an electrophotographic photoreceptor, is transferred onto a recording medium through charging, exposure, developing, and transfer processes.

In a photosensitive layer of an electrophotographic photoreceptor which is used in such an electrophotographic image forming apparatus, configurations of using a charge transport material with improved charge transport capability are known.

SUMMARY

According to an aspect of the invention, there is provided an electrophotographic photoreceptor including: a conductive substrate; and a single-layer photosensitive layer that is provided on the conductive substrate and includes a binder resin, at least one kind of charge generation material selected from hydroxygallium phthalocyanine pigments and chlorogallium phthalocyanine pigments, a hole transport material represented by Formula (1), and an electron transport material represented by Formula (2):

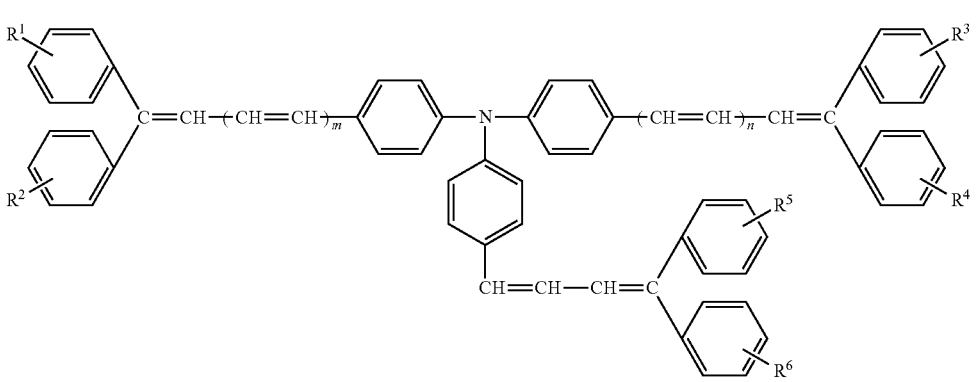

Formula (1)

wherein in Formula (1), $R^1$, $R^2$, $R^3$, $R^4$, $R^5$, and $R^6$ each independently represent a hydrogen atom, a lower alkyl group, an alkoxy group, a phenoxy group, a halogen atom, or a phenyl group which may have a substituent selected from a lower alkyl group, an alkoxy group, and a halogen atom; and m and n each independently represent 0 or 1:

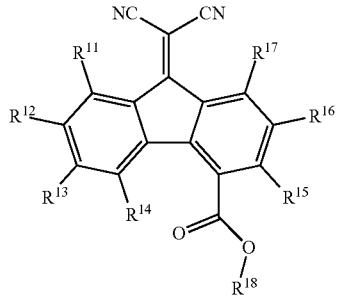

Formula (2)

wherein in Formula (2), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, or an aryl group; and $R^{18}$ represents a linear alkyl group having from 5 to 10 carbon atoms.

BRIEF DESCRIPTION OF THE DRAWINGS

Exemplary embodiments of the present invention will be described in detail based on the following figures, wherein.

DETAILED DESCRIPTION

Hereinafter, exemplary embodiments which are examples of the invention will be described.

Electrophotographic Photoreceptor

An electrophotographic photoreceptor according to an exemplary embodiment of the invention is a positively charged organic photoreceptor (hereinafter, sometimes referred to as "a single-layer photoreceptor") which includes a conductive substrate and a single-layer photosensitive layer on the conductive substrate.

The single-layer photosensitive layer includes a binder resin, at least one kind of charge generation material selected from hydroxygallium phthalocyanine pigments and chlorogallium phthalocyanine pigments, a hole transport material represented by Formula (1), and an electron transport material represented by Formula (2).

The single-layer photosensitive layer has charge generation capability, a hole transport property, and an electron transport property.

In the related art, as an electrophotographic photoreceptor, a single-layer photoreceptor is preferable from the viewpoints of manufacturing cost and image quality stability.

The single-layer photoreceptor has a configuration in which a single-layer photosensitive layer thereof includes a charge generation material, a hole transport material, and an electron transport material. Therefore, it is difficult to obtain the same level of sensitivity as that of an organic photoreceptor having a multi-layer photosensitive layer and higher sensitivity is required.

However, in the single-layer photoreceptor, in order to obtain sensitivity, even if a hole transport material and an electron transport material which have a high charge transport property are used, point defects of an image are generated while high sensitivity is obtained. The reason is considered to be that, due to the interaction with a charge generation material which is a constituent material other than the charge transport materials, the dispersibility of the charge generation material deteriorates and the charge generation material aggregates.

On the other hand, in the electrophotographic photoreceptor according to the exemplary embodiment, the single-layer photosensitive layer includes the above-described specific combination of the charge generation material, the hole transport material, and the electron transport material. As a result, high sensitivity is obtained and point defects of an image are suppressed.

The reason is not clear but is considered to be that the hole transport material and the electron transport material, which have the specific structure, have a high charge transport property; and by combining them in the specific combination, balance of wettability obtained by the interaction between the charge generation material and other materials is maintained and dispersibility of the charge generation material is improved.

Hereinafter, the electrophotographic photoreceptor according to the exemplary embodiment will be described in detail with reference to the drawings.

Figure 1:
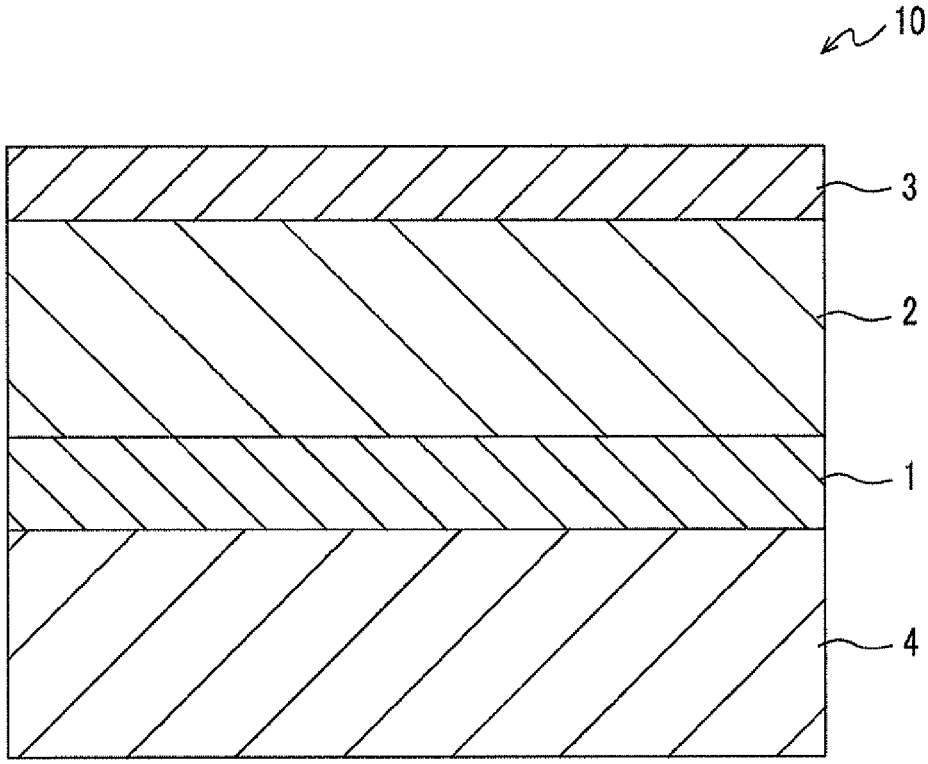
FIG. 1 is a cross-sectional view schematically illustrating a part of an electrophotographic photoreceptor according to an exemplary embodiment of the invention.

FIG. 1 is a cross-sectional view schematically illustrating a part of an electrophotographic photoreceptor 10 according to the exemplary embodiment.

The electrophotographic photoreceptor 10 illustrated in FIG. 1 includes, for example, a conductive support 4. On the conductive support 4, an undercoat layer 1, a single-layer photosensitive layer 2, and a protective layer 3 are provided in this order.

The undercoat layer 1 and the protective layer 3 are optionally provided.

Hereinafter, the respective components of the electrophotographic photoreceptor 10 will be described. Reference numerals will be omitted.

Conductive Substrate

As the conductive substrate, any conductive substrates may be used as long as they are used in related art. Examples thereof include plastic films provided with a thin film (for example, a film of a metal such as aluminum, nickel, chromium, or stainless steel, or a film of aluminum, titanium, nickel, chromium, stainless steel, gold, vanadium, tin oxide, indium oxide, or indium tin oxide (ITO)); papers coated or impregnated with a conductivity-imparting agent; and plastic films coated or impregnated with a conductivity-imparting agent. The shape of the substrate is not limited to a cylindrical shape, and may be a sheet-like shape or a plate-like shape.

When a metal pipe is used as the conductive substrate, a surface thereof may be not subjected any treatments or may be subjected in advance to mirror-surface cutting, etching, anodic oxidation, rough machining, centerless grinding, sand blasting, wet honing, or the like.

Undercoat Layer

The undercoat layer is optionally provided in order to prevent light from being reflected from the surface of the conductive substrate and prevent an unnecessary carrier from being infiltrated from the conductive substrate into the photosensitive layer.

For example, the undercoat layer includes a binder resin and optionally other additives.

Examples of the binder resin included in the undercoat layer include well-known polymer resin compounds such as acetal resins (for example, polyvinyl butyral), polyvinyl alcohol resins, caseins, polyimide resins, cellulosic resins, gelatins, polyurethane resins, polyester resins, methacrylic resins, acrylic resins, polyvinylchloride resins, polyvinyl acetate resins, vinyl chloride-vinyl acetate-maleic anhydride resins, silicone resins, silicone-alkyd resins, phenol resins, phenol-formaldehyde resins, melamine resins, urethane resins; and conductive resins such as charge transport resins or polyanilines having a charge transport group. Among these, resins which are insoluble in a coating solvent of an upper layer are preferably used. In particular, for example, phenol resins, phenol-formaldehyde resins, melamine resins, urethane resins, and epoxy resins are preferably used.

The undercoat layer may contain a metal compound such as a silicon compound, an organic zirconium compound, an organic titanium compound, or an organic aluminum compound.

The mixing ratio of the metal compound and the binder resin is not particularly limited and is set in a range where desired electrophotographic photoreceptor characteristics are obtained.

In order to adjust the surface roughness, resin particles may be added to the undercoat layer. Examples of the resin particles include silicone resin particles and cross-linked polymethylmethacrylate (PMMA) resin particles. In order to adjust the surface roughness, a surface of the undercoat layer may be polished after being formed. Examples of the polishing method include buffing, sand blasting, wet honing, and grinding.

The undercoat layer includes, for example, at least the binder resin and conductive particles. It is preferable that the conductive particles be conductive to have, for example, a volume resistivity of less than $10^7$ Ω·cm.

Examples of the conductive particles include metal particles (for example, particles of aluminum, copper, nickel, silver, or the like), conductive metal oxide particles (for example, particles of antimony oxide, indium oxide, tin oxide, zinc oxide, or the like), and particles of conductive materials (particles of carbon fiber, carbon black, or graphite powders). Among these, conductive metal oxide particles are preferable. As the conductive particles, the above examples may be used as a mixture of two or more kinds.

In addition, surfaces of the conductive particles may be treated with a hydrophobizing agent (for example, a coupling agent) and the resistance thereof may be adjusted.

The content of the conductive particles is, for example, preferably from 100% by weight to 700% by weight and more preferably from 300% by weight to 500% by weight with respect to the binder resin.

When the undercoat layer is formed, an undercoat-layer-forming coating solution in which the above components are added to a solvent is used.

In addition, examples of a method of dispersing particles in the undercoat-layer-forming coating solution include methods using media dispersers such as a ball mill, a vibration ball mill, an attritor, a sand mill, and a horizontal sand mill; and medialess dispersers such as a stirrer, an ultrasonic disperser, a roll mill, and a high-pressure homogenizer. Examples of the high-pressure homogenizer include a collision type of dispersing a dispersion through liquid-liquid collision or liquid-wall collision in a high-pressure state; and a pass-through type of dispersing a dispersion by causing it to pass through a fine flow path in a high-pressure state.

Examples of a method of coating the undercoat-layer-forming coating solution on the conductive substrate include a dip coating method, a push-up coating method, a wire-bar coating method, a spray coating method, a blade coating method, a knife coating method, and a curtain coating method.

The thickness of the undercoat layer is preferably greater than or equal to 15 μm and more preferably from 20 μm to 50 μm.

Although not illustrated in the drawing, an interlayer may be provided between the undercoat layer and the photosensitive layer. Examples of a binder resin used for the interlayer include polymer resin compounds such as acetal resins such as polyvinyl butyral, polyvinyl alcohol resins, caseins, polyimide resins, cellulosic resins, gelatins, polyurethane resins, polyester resins, methacrylic resins, acrylic resins, polyvinylchloride resins, polyvinyl acetate resins, vinyl chloride-vinyl acetate-maleic anhydride resins, silicone resins, silicone-alkyd resins, phenol-formaldehyde resins, and melamine resins; and organic metal compounds containing zirconium, titanium, aluminum, manganese, or silicon atom. These compounds may be used alone or as a mixture or a polycondensate of plural kinds of compounds. Among these, organic metal compounds containing zirconium or silicon are preferable from the viewpoints of low residual potential, less change in potential due to an environment, and less change in potential due to repetitive use.

When the interlayer is formed, an interlayer-forming coating solution in which the above components are added to a solvent is used.

Examples of a coating method used for forming the interlayer include well-known methods such as a dip coating method, a push-up coating method, a wire-bar coating method, a spray coating method, a blade coating method, a knife coating method, and a curtain coating method.

The interlayer has a function of improving a coating property of an upper layer as well as a function of an electrical blocking layer. Therefore, when the thickness thereof is too large, electrical blocking works excessively, which may lead to a decrease in sensitivity and an increase in potential due to repetitive use. Therefore, when the interlayer is formed, the thickness thereof is preferably set to be from 0.1 μm to 3 μm. In addition, in this case, the interlayer may be used as the undercoat layer.

Single-Layer Photosensitive Layer

The single-layer photosensitive layer includes a binder resin, a charge generation material, a hole transport material, an electron transport material, and optionally other additives.

Binder Resin

The binder resin is not particularly limited, and examples thereof include polycarbonate resins, polyester resins, polyarylate resins, methacrylic resins, acrylic resins, polyvinylchloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazoles, and polysilanes. As the binder resin, the above examples may be used alone or as a mixture of two or more kinds.

In particular, among these examples, polycarbonate resins having, for example, a viscosity average molecular weight of from 30,000 to 80,000 is preferable from the viewpoint of a film-forming property of the photosensitive layer.

Charge Generation Material

As the charge generation material, at least one kind selected from hydroxygallium phthalocyanine pigments and chlorogallium phthalocyanine pigments is applied.

As the charge generation material, these pigments may be used alone or in a combination of two or more kinds as necessary. As the charge generation material, hydroxygallium phthalocyanine pigments are preferable from the viewpoints of increasing sensitivity of the photoreceptor and suppressing point defects of an image.

The hydroxygallium phthalocyanine pigments are not particularly limited, but a V-type hydroxygallium phthalocyanine pigment is preferable.

In particular, as the hydroxygallium phthalocyanine pigment, a hydroxygallium phthalocyanine pigment having a maximum peak wavelength in a range of from 810 nm to 839 nm in a spectral absorption spectrum of a wavelength range of from 600 nm to 900 nm are preferable from the viewpoint of obtaining superior dispersibility. When the hydroxygallium phthalocyanine pigment is used as a material of the electrophotographic photoreceptor, superior dispersibility and sufficient sensitivity, charging property, and dark decay characteristics are easily obtained.

In addition, in the hydroxygallium phthalocyanine pigment having a maximum peak wavelength in a range of from 810 μm to 839 μm, it is preferable that the average particle diameter be in a specific range and the BET specific surface area be in a specific range. Specifically, the average particle diameter is preferably less than or equal to 0.20 μm and more preferably from 0.01 μm to 0.15 μm, and the BET specific surface area is preferably greater than or equal to 45 $m^2/g$, more preferably greater than or equal to 50 $m^2/g$, and still more preferably from 55 $m^2/g$ to 120 $m^2/g$. The average particle diameter is a value measured as a volume average particle diameter (d50 average particle diameter) with a laser diffraction/scattering particle size distribution analyzer (LA-700, manufactured by Horiba Ltd.). In addition, the BET specific surface area is a value measured using a BET specific surface area analyzer (manufactured by Shimadzu Corporation, FLOWSORB II 2300) with a nitrogen substitution method.

When the average particle diameter is greater than 0.20 μm or when the specific surface area is less than 45 $m^2/g$, pigment particles have a tendency to coarse or to form aggregates of the pigment particles. As a result, problems with characteristics such as dispersibility, sensitivity, a charging property, or dark decay characteristics are likely to occur and thus image defects are likely to occur.

The maximum particle diameter (maximum value of primary particle diameter) of the hydroxygallium phthalocyanine pigment is preferably less than or equal to 1.2 μm, more preferably less than or equal to 1.0 μm, and still more preferably less than or equal to 0.3 μm. When the maximum particle diameter is beyond the above range, dark spots are likely to occur.

In the hydroxygallium phthalocyanine pigment, it is preferable that the average particle diameter be less than or equal to 0.2 μm, the maximum particle diameter be less than or equal to 1.2 μm, and the specific surface area be greater than or equal to 45 $m^2/g$, from the viewpoint of suppressing unevenness in density caused by the photoreceptor being exposed to fluorescent light or the like.

It is preferable that the hydroxygallium phthalocyanine pigment be a V-type having diffraction peaks at Bragg angles (2θ±0.2°) of at least 7.3°, 16.0°, 24.9°, and 28.0° in an X-ray diffraction spectrum using CuKα characteristic X-rays.

The chlorogallium phthalocyanine pigment is not particularly limited, but it is preferable that the chlorogallium phthalocyanine pigment have diffraction peaks at Bragg angles (2θ±0.2°) of 7.4°, 16.6°, 25.5°, and 28.3° because superior sensitivity is obtained as an electrophotographic photoreceptor material.

Of the chlorogallium phthalocyanine pigment, the maximum peak wavelength in a spectral absorption spectrum, the average particle diameter, the maximum particle diameter, and the specific surface area which are preferable are the same as those of the hydroxygallium phthalocyanine pigment.

The content of the charge generation material is, for example, preferably from 0.05% by weight to 30% by weight, more preferably from 1% by weight to 15% by weight, and still more preferably from 2% by weight to 10% by weight, with respect to the binder resin.

Hole Transport Material

As the hole transport material, a hole transport material represented by Formula (1) is applied.

Formula (1)

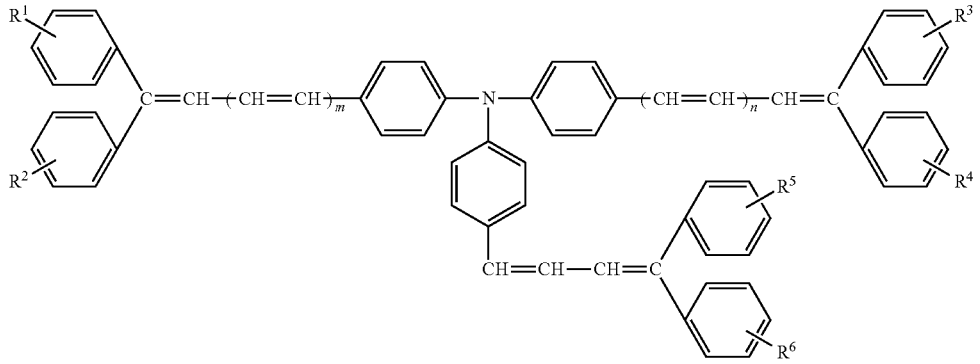

In Formula (1), $R^1$, $R^2$, $R^3$, $R^4$, $R^5$, and $R^6$ each independently represent a hydrogen atom, a lower alkyl group, an alkoxy group, a phenoxy group, a halogen atom, or a phenyl group which may have a substituent selected from a lower alkyl group, an alkoxy group, and a halogen atom; and m and n each independently represent 0 or 1.

In Formula (1), the lower alkyl group represented by $R^1$ to $R^6$ represents, for example, a linear or branched alkyl group having from 1 to 4 carbon atoms, and specific examples thereof include a methyl group, an ethyl group, an n-propyl group, an isopropyl group, an n-butyl group, and an isobutyl group.

Among these, as the lower alkyl group, a methyl group and an ethyl group are preferable.

In Formula (1), the alkoxy group represented by $R^1$ to $R^6$ represents, for example, an alkoxy group having from 1 to 4 carbon atoms, and specific examples thereof include a methoxy group, an ethoxy group, a propoxy group, and a butoxy group.

In Formula (1), examples of the halogen atom represented by $R^1$ to $R^6$ include a fluorine atom, a chlorine atom, a bromine atom, or an iodine atom.

In Formula (1), the phenyl group represented by $R^1$ to $R^6$ represents, for example, an unsubstituted phenyl group; a phenyl group substituted with a lower alkyl group such as a p-tolyl group or a 2,4-dimethylphenyl group; a phenyl group substituted with a lower alkoxy group such as p-methoxyphenyl group; and a phenyl group substituted with a halogen atom such as p-chlorophenyl group.

Examples of the substituent which may be substituted with a phenyl group include a lower alkyl group, an alkoxy group, and a halogen atom which are represented by $R^1$ to $R^6$.

As the hole transport material represented by Formula (1), from the viewpoints of increasing sensitivity and suppressing point defects of an image, a hole transport material in which m and n represent 1 is preferable and a hole transport material in which $R^1$ to $R^6$ each independently represent a hydrogen atom, a lower alkyl group, or an alkoxy group; and m and n represent 1 is particularly preferable.

Hereinafter, exemplary compounds of the hole transport material represented by Formula (1) are shown below, but the hole transport material represented by Formula (1) is not limited thereto. Hereinafter, the following Nos. of the exemplary compounds are denoted by "Exemplary Compound (1-No.)". For example, specifically, the exemplary compound No. 15 is denoted by "Exemplary Compound (1-15)".

| Exemplary Compound | m | n | $R^1$ | $R^2$ | $R^3$ | $R^4$ | $R^5$ | $R^6$ |
|---|---|---|---|---|---|---|---|---|
| 1 | 1 | 1 | H | H | H | H | H | H |
| 2 | 1 | 1 | 4-Me | 4-Me | 4-Me | 4-Me | 4-Me | 4-Me |
| 3 | 1 | 1 | 4-Me | 4-Me | H | H | 4-Me | 4-Me |
| 4 | 1 | 1 | 4-Me | H | 4-Me | H | 4-Me | H |
| 5 | 1 | 1 | H | H | 4-Me | 4-Me | H | H |
| 6 | 1 | 1 | 3-Me | 3-Me | 3-Me | 3-Me | 3-Me | 3-Me |
| 7 | 1 | 1 | H | H | H | H | 4-Cl | 4-Cl |
| 8 | 1 | 1 | 4-MeO | H | 4-MeO | H | 4-MeO | H |
| 9 | 1 | 1 | H | H | H | H | 4-MeO | 4-MeO |
| 10 | 1 | 1 | 4-MeO | 4-MeO | 4-MeO | 4-MeO | 4-MeO | 4-MeO |
| 11 | 1 | 1 | 4-MeO | H | 4-MeO | H | 4-MeO | 4-MeO |
| 12 | 1 | 1 | 4-Me | H | 4-Me | H | 4-Me | 4-F |
| 13 | 1 | 1 | 3-Me | H | 3-Me | H | 3-Me | H |
| 14 | 1 | 1 | 4-Cl | H | 4-Cl | H | 4-Cl | H |
| 15 | 1 | 1 | 4-Cl | 4-Cl | 4-Cl | 4-Cl | 4-Cl | 4-Cl |
| 16 | 1 | 1 | 3-Me | 3-Me | 3-Me | 3-Me | 3-Me | 3-Me |
| 17 | 1 | 1 | 4-Me | 4-MeO | 4-Me | 4-MeO | 4-Me | 4-MeO |
| 18 | 1 | 1 | 3-Me | 4-MeO | 3-Me | 4-MeO | 3-Me | 4-MeO |
| 19 | 1 | 1 | 3-Me | 4-Cl | 3-Me | 4-Cl | 3-Me | 4-Cl |
| 20 | 1 | 1 | 4-Me | 4-Cl | 4-Me | 4-Cl | 4-Me | 4-Cl |
| 21 | 1 | 0 | H | H | H | H | H | H |
| 22 | 1 | 0 | 4-Me | 4-Me | 4-Me | 4-Me | 4-Me | 4-Me |
| 23 | 1 | 0 | 4-Me | 4-Me | H | H | 4-Me | 4-Me |
| 24 | 1 | 0 | H | H | 4-Me | 4-Me | H | H |
| 25 | 1 | 0 | H | H | 3-Me | 3-Me | H | H |
| 26 | 1 | 0 | H | H | 4-Cl | 4-Cl | H | H |
| 27 | 1 | 0 | 4-Me | H | H | H | 4-Me | H |
| 28 | 1 | 0 | 4-MeO | H | H | H | 4-MeO | H |
| 29 | 1 | 0 | H | H | 4-MeO | 4-MeO | H | H |
| 30 | 1 | 0 | 4-MeO | 4-MeO | 4-MeO | 4-MeO | 4-MeO | 4-MeO |
| 31 | 1 | 0 | 4-MeO | H | 4-MeO | H | 4-MeO | 4-MeO |
| 32 | 1 | 0 | 4-Me | H | 4-Me | H | 4-Me | 4-F |
| 33 | 1 | 0 | 3-Me | H | 3-Me | H | 3-Me | H |
| 34 | 1 | 0 | 4-Cl | H | 4-Cl | H | 4-Cl | H |
| 35 | 1 | 0 | 4-Cl | 4-Cl | 4-Cl | 4-Cl | 4-Cl | 4-Cl |
| 36 | 1 | 0 | 3-Me | 3-Me | 3-Me | 3-Me | 3-Me | 3-Me |
| 37 | 1 | 0 | 4-Me | 4-MeO | 4-Me | 4-MeO | 4-Me | 4-MeO |
| 38 | 1 | 0 | 3-Me | 4-MeO | 3-Me | 4-MeO | 3-Me | 4-MeO |
| 39 | 1 | 0 | 3-Me | 4-Cl | 3-Me | 4-Cl | 3-Me | 4-Cl |
| 40 | 1 | 0 | 4-Me | 4-Cl | 4-Me | 4-Cl | 4-Me | 4-Cl |
| 41 | 0 | 0 | H | H | H | H | H | H |
| 42 | 0 | 0 | 4-Me | 4-Me | 4-Me | 4-Me | 4-Me | 4-Me |
| 43 | 0 | 0 | 4-Me | 4-Me | 4-Me | 4-Me | H | H |
| 44 | 0 | 0 | 4-Me | H | 4-Me | H | H | H |
| 45 | 0 | 0 | H | H | H | H | 4-Me | 4-Me |
| 46 | 0 | 0 | 3-Me | 3-Me | 3-Me | 3-Me | H | H |
| 47 | 0 | 0 | H | H | H | H | 4-Cl | 4-Cl |
| 48 | 0 | 0 | 4-MeO | H | 4-MeO | H | H | H |
| 49 | 0 | 0 | H | H | H | H | 4-MeO | 4-MeO |
| 50 | 0 | 0 | 4-MeO | 4-MeO | 4-MeO | 4-MeO | 4-MeO | 4-MeO |
| 51 | 0 | 0 | 4-MeO | H | 4-MeO | H | 4-MeO | 4-MeO |
| 52 | 0 | 0 | 4-Me | H | 4-Me | H | 4-Me | 4-F |
| 53 | 0 | 0 | 3-Me | H | 3-Me | H | 3-Me | H |
| 54 | 0 | 0 | 4-Cl | H | 4-Cl | H | 4-Cl | H |
| 55 | 0 | 0 | 4-Cl | 4-Cl | 4-Cl | 4-Cl | 4-Cl | 4-Cl |
| 56 | 0 | 0 | 3-Me | 3-Me | 3-Me | 3-Me | 3-Me | 3-Me |
| 57 | 0 | 0 | 4-Me | 4-MeO | 4-Me | 4-MeO | 4-Me | 4-MeO |
| 58 | 0 | 0 | 3-Me | 4-MeO | 3-Me | 4-MeO | 3-Me | 4-MeO |
| 59 | 0 | 0 | 3-Me | 4-Cl | 3-Me | 4-Cl | 3-Me | 4-Cl |
| 60 | 0 | 0 | 4-Me | 4-Cl | 4-Me | 4-Cl | 4-Me | 4-Cl |
| 61 | 1 | 1 | 4-Pr | 4-Pr | 4-Pr | 4-Pr | 4-Pr | 4-Pr |

-continued

| Exemplary Compound | m | n | $R^1$ | $R^2$ | $R^3$ | $R^4$ | $R^5$ | $R^6$ |
|---|---|---|---|---|---|---|---|---|
| 62 | 1 | 1 | 4-PhO | 4-PhO | 4-PhO | 4-PhO | 4-PhO | 4-PhO |
| 63 | 1 | 1 | H | 4-Me | H | 4-Me | H | 4-Me |
| 64 | 1 | 1 | 4-$C_6H_5$ | 4-$C_6H_5$ | 4-$C_6H_5$ | 4-$C_6H_5$ | 4-$C_6H_5$ | 4-$C_6H_5$ |

The abbreviations of the exemplary compounds shown above represent as follows.
4-Me: Methyl group substituted at 4-position of phenyl group
3-Me: Methyl group substituted at 3-position of phenyl group
4-Cl: Chlorine atom substituted at 4-position of phenyl group
4-MeO: Methoxy group substituted at 4-position of phenyl group
4-F: Fluorine atom substituted at 4-position of phenyl group
4-Pr: Propyl group substituted at 4-position of phenyl group
4-PhO: Phenoxy group substituted at 4-position of phenyl group The content of the hole transport material is, for example, preferably from 10% by weight to 98% by weight, more preferably from 60% by weight to 95% by weight, and still more preferably from 70% by weight to 90% by weight, with respect to the binder resin.

Electron Transport Material

As the electron transport material, an electron transport material represented by Formula (2) is applied.

Formula (2)

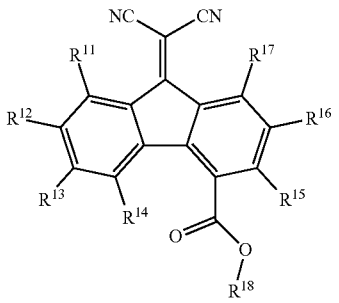

In Formula (2), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, or an aryl group; and $R^{18}$ represents a linear alkyl group having from 5 to 10 carbon atoms.

In Formula (2), examples of the halogen atom represented by $R^{11}$ to $R^{17}$ include a fluorine atom, a chlorine atom, a bromine atom, or an iodine atom.

In Formula (2), the alkyl group represented by $R^{11}$ to $R^{17}$ represents, for example, a linear or branched alkyl group having from 1 to 4 carbon atoms (preferably having from 1 to 3 carbon atoms), and specific examples thereof include a methyl group, an ethyl group, an n-propyl group, an isopropyl group, an n-butyl group, and an isobutyl group.

In Formula (2), the alkoxy group represented by $R^{11}$ to $R^{17}$ represents, for example, an alkoxy group having from 1 to 4 carbon atoms (preferably having from 1 to 3 carbon atoms), and specific examples thereof include a methoxy group, an ethoxy group, a propoxy group, and a butoxy group.

In Formula (2), examples of the aryl group represented by $R^{11}$ to $R^{17}$ include a phenyl group, a benzyl group, and a tolyl group.

Among these, a phenyl group is preferable.

As the electron transport material represented by Formula (2), from the viewpoints of increasing sensitivity and suppressing point defects of an image, an electron transport material, in which $R^{11}$ to $R^{17}$ each independently represent a hydrogen atom, a halogen atom, or an alkyl group; and $R^{16}$ represents a linear alkyl group having from 5 to 10 carbon atoms, is preferable.

Hereinafter, exemplary compounds of the electron transport material represented by Formula (2) are shown below, but the electron transport material represented by Formula (2) is not limited thereto. Hereinafter, the following Nos. of the exemplary compounds are denoted by "Exemplary Compound (2-No.)". For example, specifically, the exemplary compound No. 15 is denoted by "Exemplary Compound (2-15)".

| Exemplary Compound | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| 1 | H | H | H | H | H | H | H | —n-$C_7H_{15}$ |
| 2 | H | H | H | H | H | H | H | —n-$C_8H_{17}$ |
| 3 | H | H | H | H | H | H | H | —n-$C_5H_{11}$ |
| 4 | H | H | H | H | H | H | H | —n-$C_{10}H_{21}$ |
| 5 | Cl | Cl | Cl | Cl | Cl | Cl | Cl | —n-$C_7H_{15}$ |
| 6 | H | Cl | H | Cl | H | Cl | Cl | —n-$C_7H_{15}$ |
| 7 | $CH_3$ | $CH_3$ | $CH_3$ | $CH_3$ | $CH_3$ | $CH_3$ | $CH_3$ | —n-$C_7H_{15}$ |
| 8 | $C_4H_9$ | $C_4H_9$ | $C_4H_9$ | $C_4H_9$ | $C_4H_9$ | $C_4H_9$ | $C_4H_9$ | —n-$C_7H_{15}$ |
| 9 | $CH_3O$ | H | $CH_3O$ | H | $CH_3O$ | H | $CH_3O$ | —n-$C_8H_{17}$ |
| 10 | $C_6H_5$ | $C_6H_5$ | $C_6H_5$ | $C_6H_5$ | $C_6H_5$ | $C_6H_5$ | $C_6H_5$ | —n-$C_6H_{17}$ |

The content of the electron transport material is, for example, preferably from 10% by weight to 70% by weight, more preferably from 15% by weight to 50% by weight, and still more preferably from 20% by weight to 40% by weight, with respect to the binder resin.

Other Charge Transport Material

In addition to the specific hole transport material and electron transport material, other charge transport materials (other hole transport material and other electron transport material) may be used in combination in a range not impairing the functions thereof. In this case, the content of other charge transport material to be used in combination is preferably less than or equal to 10% by weight with respect to the total amount of the hole transport material and the electron transport material.

Examples of other charge transport material include electron transport compounds such as quinone compounds (for example, p-benzoquinone, chloranil, bromanil, and anthraquinone), tetracyanoquinodimethane compounds, fluorenone compounds (for example, 2,4,7-trinitrofluorenone), xanthone compounds, benzophenone compounds, cyanovinyl compounds, and ethylene compounds; and hole transport compounds such as triarylamine compounds, benzidine compounds, arylalkane compounds, aryl-substituted ethylene compounds, stilbene compounds, anthracene compounds, and hydrazone compounds. As other charge transport materials, the above examples may be used alone or as a mixture of two or more kinds thereof, but other charge transport materials are not limited thereto.

As other charge transport materials, from the viewpoint of charge mobility, triarylamine derivatives represented by Formula (B-1) and benzidine derivatives represented by Formula (B-2) are preferable.

(B-1)

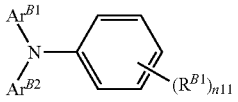

In Formula (B-1), $R^{B1}$ represents a hydrogen atom or a methyl group; n11 represents 1 or 2; $Ar^{B1}$ and $Ar^{B2}$ each independently represent a substituted or unsubstituted aryl group, $—C_6H_4—C(R^{B3})=C(R^{B4})(R^{B5})$, or $—C_6H_4—CH=CH—CH=C(R^{B6})(R^{B7})$; and $R^{B3}$ to $R^{B7}$ each independently represent a hydrogen atom, a substituted or unsubstituted alkyl group, or a substituted or unsubstituted aryl group. Examples of a substituent include a halogen atom, an alkyl group having from 1 to 5 carbon atoms, an alkoxy group having from 1 to 5 carbon atoms, or a substituted amino group substituted with an alkyl group having from 1 to 3 carbon atoms.

(B-2)

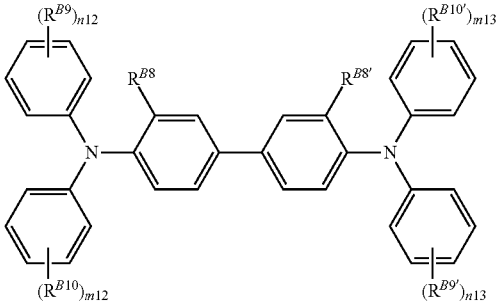

(In Formula (B-2), $R^{B8}$ and $R^{B8'}$ may be the same as or different from each other and each independently represent a hydrogen atom, a halogen atom, an alkyl group having from 1 to 5 carbon atoms, or an alkoxy group having from 1 to 5 carbon atoms; $R^{B9}$, $R^{B9'}$, $R^{B10}$, and $R^{B10'}$ may be the same as or different from each other and each independently represent a halogen atom, an alkyl group having from 1 to 5 carbon atoms, an alkoxy group having from 1 to 5 carbon atoms, an amino group substituted with an alkyl group having 1 or 2 carbon atoms, a substituted or unsubstituted aryl group, $—C(R^{B11})=C(R^{B12})(R^{B13})$, or $—CH=CH—CH=C(R^{B14})(R^{B15})$; $R^{B11}$ to $R^{B15}$ each independently represent a hydrogen atom, a substituted or unsubstituted alkyl group, or a substituted or unsubstituted aryl group; and m12, m13, n12, and n13 each independently represent an integer of from 0 to 2.)

Among the triarylamine derivatives represented by Formula (B-1) and the benzidine derivatives represented by Formula (B-2), a triarylamine derivative having $—C_6H_4—CH=CH—CH=C(R^{B6})(R^{B7})$ and a benzidine derivative having $—CH=CH—CH=C(R^{B14})(R^{B15})$ are preferable.

Ratio of Hole Transport Material to Electron Transport Material

The ratio of the hole transport material to the electron transport material (hole transport material/electron transport material) is preferably from 50/50 to 90/10 and more preferably from 60/40 to 80/20 in terms of weight.

When other charge transport materials are used in combination, this ratio represents a ratio of the total amounts thereof.

Other Additives

The single-layer photosensitive layer may contain well-known additives such as an antioxidant, a light stabilizer, and a heat stabilizer. In addition, when the single-layer photosensitive layer is a surface layer, fluororesin particles, silicone oil, and the like may be included therein.

Formation of Single-Layer Photosensitive Layer

The single-layer photosensitive layer is formed using a photosensitive-layer-forming coating solution in which the above components are added to a solvent.

Examples of the solvent include well-known organic solvents including aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. As the solvent, the above examples may be used alone or as a mixture of two or more kinds.

Examples of a method of dispersing particles (for example, particles of a charge generation material) in the photosensitive-layer-forming coating solution include methods using media dispersers such as a ball mill, a vibration ball mill, an attritor, a sand mill, and a horizontal sand mill; and medialess dispersers such as a stirrer, an ultrasonic disperser, a roll mill, and a high-pressure homogenizer. Examples of the high-pressure homogenizer include a collision type of dispersing a dispersion through liquid-liquid collision or liquid-wall collision in a high-pressure state; and a pass-through type of dispersing a dispersion by causing it to pass through a fine flow path in a high-pressure state.

Examples of a method of coating the photosensitive-layer-forming coating solution on the undercoat layer include a dip coating method, a push-up coating method, a wire-bar coating method, a spray coating method, a blade coating method, a knife coating method, and a curtain coating method.

The thickness of the single-layer photosensitive layer is preferably from 5 μm to 60 μm and more preferably from 10 μm to 50 μm.

Protective Layer

The protective layer is optionally provided in order to improve mechanical strength of the photosensitive layer and resistance to wear, damages, and the like on the surface of the electrophotographic photoreceptor.

Examples of the protective layer include well-known protective layers such as a polymer film (cross-linked film) of reactive charge transport materials, a resin cured film containing charge transport materials in a curable resin, and a film formed by adding a conductive material to a binder resin. As the protective film, a film using charge transport materials is preferable.

The thickness of the protective film is, for example, preferably from 3 μm to 40 μm, more preferably from 5 μm to 35 μm, and still more preferably from 5 μm to 15 μm.

Image Forming Apparatus and Process Cartridge

An image forming apparatus according to an exemplary embodiment of the invention includes the electrophotographic photoreceptor according to the exemplary embodiment; charging unit that charges the electrophotographic photoreceptor; an electrostatic latent image forming unit that forms an electrostatic latent image on a charged electrophotographic photoreceptor; a developing unit that accommodates a developer containing a toner and develops the electrostatic latent image, formed on the electrophotographic photoreceptor, using the developer to form a toner image; and a transfer unit that transfers the toner image onto a transfer medium.

Figure 2:
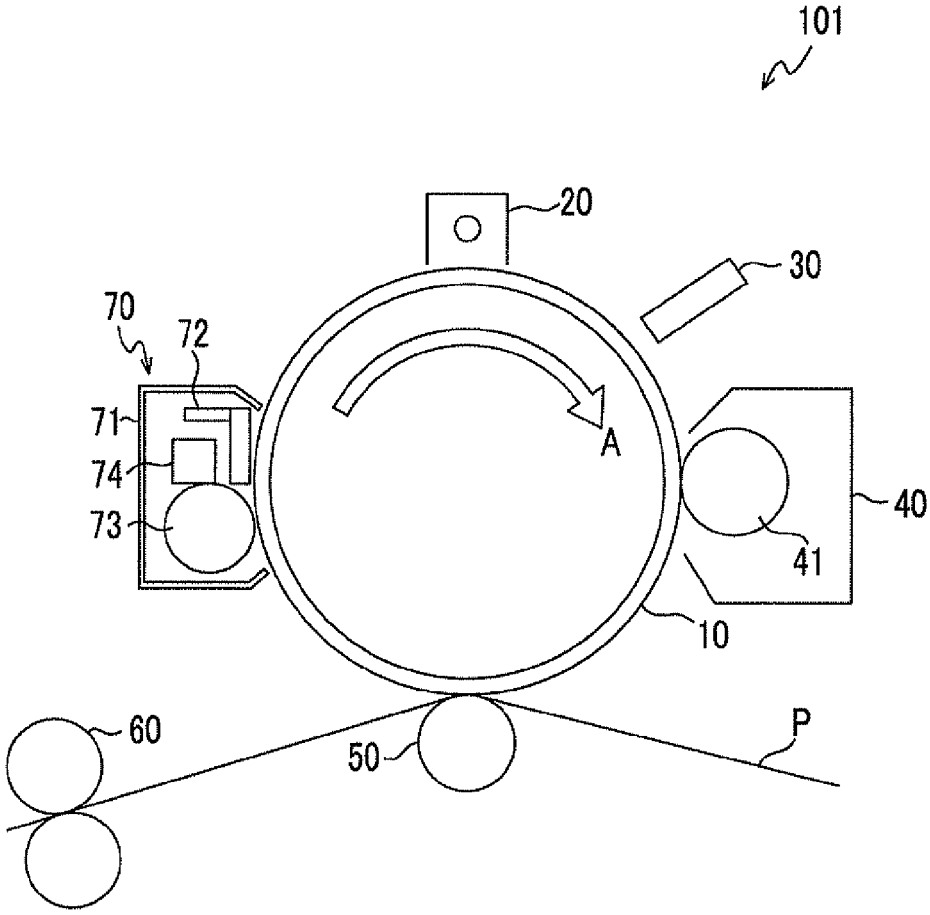
FIG. 2 is a diagram schematically illustrating a configuration of an image forming apparatus according to an exemplary embodiment of the invention.

FIG. 2 is a diagram schematically illustrating a configuration of an image forming apparatus according to an exemplary embodiment of the invention.

As illustrated in FIG. 2, an image forming apparatus 101 according to the exemplary embodiment includes an electrophotographic photoreceptor 10 that rotates clockwise, for example, as indicated by arrow A; a charging device 20 (an example of a charging unit) that is provided facing to the electrophotographic photoreceptor 10 above the electrophotographic photoreceptor 10 and charges the surface of the electrophotographic photoreceptor 10; an exposure device 30 (an example of an electrostatic latent image forming unit) that exposes the surface of the electrophotographic photoreceptor 10, which is charged by the charging device 20, to light to form an electrostatic latent image; a developing device 40 (an example of a developing unit) that attaches a toner, which is included in a developer, to the electrostatic latent image, which is formed by the exposure device 30, to form a toner image on the surface of the electrophotographic photoreceptor 10; a transfer device 50 that charges a recording paper P (an example of transfer medium) to have a polarity different from a charge polarity of the toner such that the toner image on the electrophotographic photoreceptor 10 is transferred onto the recording paper P; and a cleaning device 70 (an example of a toner removal unit) that cleans the surface of the electrophotographic photoreceptor 10. In addition, a fixing device 60 that fixes the toner image while transporting the recording paper P on which the toner image is formed, is provided.

Hereinafter, main components of the image forming apparatus 101 according to the exemplary embodiment will be described in detail.

Charging Device

Examples of the charging device 20 include contact charging devices using a charging roller, a charging brush, a charging film, a charging rubber blade, a charging tube, and the like which are conductive. In addition, examples of the charging device 20 include non-contact roller charging devices and well-known charging devices such as a scorotron charger or corotron charger using corona discharge. As the charging device 20, contact charging devices are preferable.

Exposure Device

Examples of the exposure device 30 include optical devices with which the surface of the electrophotographic photoreceptor 10 is exposed to light such as semiconductor laser light, LED light, and liquid crystal shutter light according to an image form. It is preferable that the wavelength of a light source fall within the spectral sensitivity range of the electrophotographic photoreceptor 10. It is preferable that the wavelength of a semiconductor laser light be in the near-infrared range having an oscillation wavelength of, for example, about 780 nm. However, the wavelength is not limited thereto. Laser light having an oscillation wavelength of about 600 nm or laser light having an oscillation wavelength of 400 nm to 450 nm as blue laser light may be used. In addition, in order to form a color image, as the exposure device 30, for example, a surface-emitting laser light source of emitting multiple beams is also effective.

Developing Device

The developing device 40 has, for example, a configuration in which a developing roller 41, which is arranged in a development area opposite the electrophotographic photoreceptor 10, is provided in a container that accommodates a two-component developer including toner and a carrier. The developing device 40 is not particularly limited as long as it uses a two-component developer for development, and adopts a well-known configuration.

The developer used in the developing device 40 may be a single-component developer including toner or a two-component developer including toner and a carrier.

Transfer Device

Examples of the transfer device 50 include contact transfer charging devices using a belt, a roller, a film, a rubber blade, and the like; and well-known transfer charging devices such as scorotron transfer charger or corotron transfer charger using corona discharge.

Cleaning Device

The cleaning device 70 includes, for example, a case 71, a cleaning blade 72, a cleaning brush 73 which is disposed downstream of the cleaning blade 72 in a rotating direction of the electrophotographic photoreceptor 10. In addition, for example, the cleaning brush 73 is in contact with a solid lubricant 74.

Next, the operations of the image forming apparatus 101 according to the exemplary embodiment will be described. First, the electrophotographic photoreceptor 10 is charged to a negative potential by the charging device 20 while rotating along the direction indicated by arrow A.

The surface of the electrophotographic photoreceptor 10, which is charged to a negative potential by the charging device 20, is exposed to light by the exposure device 30 and an electrostatic latent image is formed thereon.

When a portion of the electrophotographic photoreceptor 10, where the electrostatic latent image is formed, approaches the developing device 40, toner is attached onto the electrostatic latent image by the developing device 40 (developing roller 41) and thus a toner image is formed.

When the electrophotographic photoreceptor 10 where the toner image is formed further rotates in the direction indicated by arrow A, the toner image is transferred onto the recording paper P by the transfer device 50. As a result, the toner image is formed on the recording paper P.

The toner image, which is formed on the recording paper P, is fixed on the recording paper P by the fixing device 60.

Figure 3:
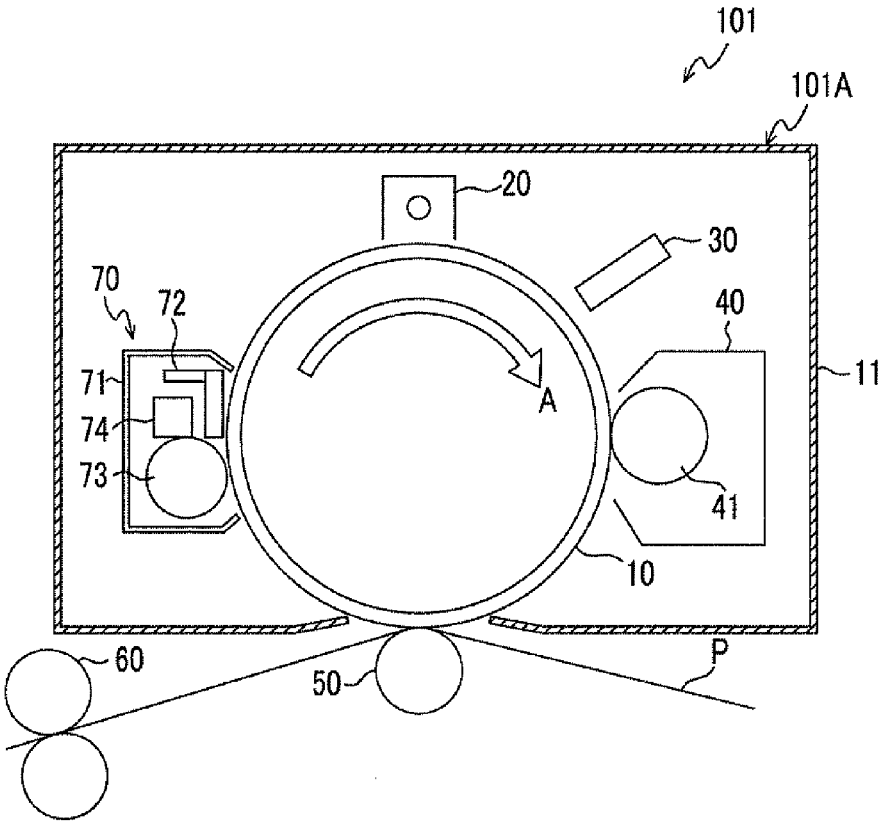
FIG. 3 is a diagram schematically illustrating a configuration of an image forming apparatus according to another exemplary embodiment of the invention.

For example, as illustrated in FIG. 3, the image forming apparatus 101 according to the exemplary embodiment may include a process cartridge 101A which integrally accommodates the electrophotographic photoreceptor 10, the charging device 20, the exposure device 30, the developing device 40, and the cleaning device 70 in the case 11. This process cartridge 101A integrally accommodates the plural members and is detachable from the image forming apparatus 101.

The process cartridge 101A is not limited to the above configuration as long as it includes at least the electrophotographic photoreceptor 10, and may further include at least one selected from the charging device 20, the exposure device 30, the developing device 40, the transfer device 50, and the cleaning device 70.

In addition, the image forming apparatus 101 according to the exemplary embodiment is not limited to the above-described configurations. For example, a first erasing device for aligning the polarity of remaining toner and facilitating the cleaning brush to remove the remaining toner may be provided downstream of the transfer device 50 in the rotating direction of the electrophotographic photoreceptor 10 and upstream of the cleaning device 70 in the rotating direction of the electrophotographic photoreceptor 10 in the vicinity of the electrophotographic photoreceptor 10; or a second erasing device for erasing the charge on the surface of the electrophotographic photoreceptor 10 may be provided downstream of the cleaning device 70 in the rotating direction of the electrophotographic photoreceptor 10 and upstream of the charging device 20 in the rotating direction of the electrophotographic photoreceptor 10.

In addition, the image forming apparatus 101 according to the exemplary embodiment is not limited to the above-described configurations and well-known configurations may be adopted. For example, an intermediate transfer type image forming apparatus, in which the toner image, which is formed on the electrophotographic photoreceptor 10, is transferred onto an intermediate transfer medium and then transferred onto the recording paper P, may be adopted; or a tandem-type image forming apparatus may be adopted.

EXAMPLES

Hereinafter, the present invention will be described in detail with reference to Examples and Comparative Examples but is not limited to the following Examples.

Example 1

3 parts by weight of V-type hydroxygallium phthalocyanine pigment, as a charge generation material, having diffraction peaks at Bragg angles (2θ±0.2°) of at least 7.3', 16.0', 24.9°, and 28.9° in an X-ray diffraction spectrum using CuKα characteristic X-rays, 47 parts by weight of bisphenol Z polycarbonate resin (viscosity average molecular weight: 50,000) as a binder resin, 13 parts by weight of electron transport material shown in Table 1, 37 parts by weight of hole transport material shown in Table 1, and 250 parts by weight of tetrahydrofuran as a solvent are mixed to prepare a mixture. The mixture is dispersed for 4 hours using a sand mill with glass bead having a diameter of 1 mmϕ. As a result, a photosensitive-layer-forming coating solution is obtained.

This photosensitive-layer-forming coating solution is dip-coated on an aluminum substrate having a diameter of 30 mm and a length of 244.5 mm, followed by drying and curing at 140° C. for 30 minutes. As a result, a single-layer photosensitive layer having a thickness of 30 μm is formed.

Through the above-described processes, an electrophotographic photoreceptor is prepared.

Examples 2 to 35 and Comparative Examples 1 to 12

Electrophotographic photoreceptors are prepared with the same method of Example 1, except that the kinds and the amounts of the electron transport material, the hole transport material, the binder resin, and the charge generation material are changed according to Tables 1 to 3. In Tables 1 to 3, "part" represents "part by weight".

Example 36

A single-layer photosensitive layer is formed on an undercoat layer and an electrophotographic photoreceptor is prepared in the same method as that of Example 1, except that, an undercoat layer is formed on an aluminum substrate with the following method.

Formation of Undercoat Layer 100 parts by weight of zinc oxide particles (average particle diameter: 70 nm, manufactured by TAYCA CORPORATION, specific surface area: 15 $m^2/g$) and 500 parts by weight of tetrahydrofuran are stirred and mixed and 1.3 parts by weight of silane coupling agent (KBM 503, manufactured by Shin-Etsu Chemical Co., Ltd.) is added thereto, followed by stirring for 2 hours. Next, tetrahydrofuran is removed by distillation under reduced pressure, followed by baking at 120° C. for 3 hours. As a result, zinc oxide particles with surfaces treated with a silane coupling agent are obtained.

110 parts by weight of zinc oxide particles with the treated surfaces is added to 500 parts by weight of tetrahydrofuran, followed by stirring and mixing. Then, a solution in which 0.6 part by weight of alizarin is dissolved in 50 parts by weight of tetrahydrofuran is added thereto, followed by stirring at 50° C. for 5 hours. Next, zinc oxide particles with alizarin added are separated through filtration under reduced pressure, followed by drying under reduced pressure at 60° C. As a result, zinc oxide particles with alizarin added are obtained.

60 parts by weight of the obtained zinc oxide particles with alizarin added, 13.5 parts by weight of curing agent (blocked isocyanate, SUMIDUR 3175, manufactured by Sumitomo Bayer Urethane Co., Ltd.), and 15 parts by weight of butyral resin (S-LEC BM-1, manufactured by SEKISUI CHEMICAL CO., LTD.) are dissolved in 85 parts by weight of methyl ethyl ketone to prepare a solution. 38 parts by weight of the obtained solution and 25 parts by weight of methyl ethyl ketone are mixed, followed by dispersion with a sand mill for 2 hours using glass beads with a diameter of 1 mmϕ. As a result, a dispersion is obtained.

0.005 part by weight of dioctyl tin dilaurate as a catalyst and 40 parts by weight of silicone resin particles (TOSPEARL 145, manufactured by GE Toshiba Silicones Co., Ltd.) are added to the obtained dispersion. As a result, an undercoat-layer-forming coating solution is obtained. This coating solution is dip-coated on an aluminum substrate having a diameter of 30 mm and a length of 245 mm, followed by drying and curing at 170° C. for 40 minutes. As a result, an undercoat layer with a thickness of 19 μm is formed.

Example 37

A single-layer photosensitive layer is formed on an undercoat layer and an electrophotographic photoreceptor is prepared in the same method as that of Example 1, except that, an undercoat layer is formed on an aluminum substrate with the following method.

Formation of Undercoat Layer 3 parts of soluble nylon (AMILAN CM 8000, manufactured by Toray Industries, Inc.) is dissolved in 97 parts of a mixed solvent of methanol and methylene chloride (methanol/methylene chloride=5/5) to obtain a coating solution. This coating solution is dip-coated on an aluminum substrate having a diameter of 30 mm and a length of 245 mm, followed by drying at 100° C. for 60 minutes. As a result, an undercoat layer with a thickness of 0.3 μm is formed.

Evaluation

The electrophotographic photoreceptors obtained in the respective Examples are evaluated as follows. The results thereof are shown in Tables 1 to 3.

Dispersibility of Charge Generation Material

The dispersibility of pigment is evaluated by measuring an absorbance with an ultraviolet-visible spectrophotometer U2000 (manufactured by Hitachi Ltd.) and calculating a ratio of coarse particles according the following expression.

$$\text{Ratio of Coarse Particles}=A1000/A780\times100 \quad \text{Expression}$$

In the expression, A1000 represents an absorbance in a wavelength of 1,000 nm and A780 represents an absorbance in a wavelength of 780 nm When the ratio of the coarse particles is greater than or equal to 20, image defects (point defects) caused by aggregates of charge generation materials are generated and thus the dispersibility of pigment is evaluated that there is a problem in practice.

Evaluation for Sensitivity of Photoreceptor

The sensitivity of a photoreceptor is evaluated with a half decay exposure when the photoreceptor is charged to +800 V. Specifically, a photoreceptor is charged to +800 V with an electrostatic analyzer (EPA-8100, manufactured by Kawaguchi Electric Works Co., Ltd.) in an environment of 20° C. and 40% RH; tungsten lamp light is converted to monochromatic light with a wavelength of 800 nm using a monochromator; and a surface of the photoreceptor is illuminated with this monochromatic light which is adjusted so as to have an exposure of 1 $\mu W/cm^2$.

When the surface potential of the surface of the photoreceptor immediately after being charged is $V_0$ (V) and the surface potential of the surface of the photoreceptor after being illuminated with the light is $\frac{1}{2}\times V_0$ (V), a half decay exposure $E\frac{1}{2}$ ($\mu J/cm^2$) is measured.

When the half decay exposure is less than or equal to 0.2 $\mu J/cm^2$, the sensitivity of the photoreceptor is evaluated as being increased.

Evaluation for Image Quality

Image quality is evaluated with a method in which a 50% halftone image is printed using a HL-5340D (manufactured by Brother Industries Ltd.) and point defects of the image is evaluated based on the following criteria.

5: Very satisfactory (there are no point defects)

4: Satisfactory (there are almost no point defects)

3: Normal (there are point defects, which is in an allowable range)

2: Unsatisfactory (there are point defects, which are not in an allowable range)

1: Very unsatisfactory (there are many point defects, which are not in an allowable range)

When the scale is 1 or 2, it is evaluated that there may be a problem in practice.

TABLE 1

| | Electron Transport Material | | Hole Transport Material | | | | Binder Resin | | Charge Generation Material | | Evaluation | | |
|---|---|---|---|---|---|---|---|---|---|---|---|---|---|
| | Kind | Part | Kind | Part | Kind | Part | Kind | Part | Kind | Part | Sensitivity (Half-Decay Exposure $\mu J/cm^2$) | Dispersibility (Ratio of Coarse Particles) | Image Quality (Point Defects) |
| Example 1 | (2-1) | 13 | (1-1) | 37 | — | 0 | PCZ | 47 | HOGaPC (V-Type) | 3 | 0.11 | 11 | 5 |
| Example 2 | (2-2) | 13 | (1-1) | 19 | Compound 10 | 18 | PCZ | 47 | HOGaPC (V-Type) | 3 | 0.12 | 12 | 5 |
| Example 3 | (2-3) | 13 | (1-1) | 19 | Compound 10 | 18 | PCZ | 47 | HOGaPC (V-Type) | 3 | 0.12 | 13 | 5 |
| Example 4 | (2-4) | 13 | (1-1) | 19 | Compound 10 | 18 | PCZ | 47 | HOGaPC (V-Type) | 3 | 0.13 | 11 | 5 |
| Example 5 | (2-1) | 13 | (1-2) | 19 | Compound 10 | 18 | PCZ | 47 | HOGaPC (V-Type) | 3 | 0.12 | 10 | 5 |
| Example 6 | (2-1) | 13 | (1-61) | 19 | Compound 10 | 18 | PCZ | 47 | HOGaPC (V-Type) | 3 | 0.12 | 10 | 5 |
| Example 7 | (2-1) | 13 | (1-10) | 19 | Compound 10 | 18 | PCZ | 47 | HOGaPC (V-Type) | 3 | 0.13 | 11 | 5 |
| Example 8 | (2-1) | 13 | (1-62) | 19 | Compound 10 | 18 | PCZ | 47 | HOGaPC (V-Type) | 3 | 0.15 | 12 | 5 |
| Example 9 | (2-1) | 13 | (1-15) | 19 | Compound 10 | 18 | PCZ | 47 | HOGaPC (V-Type) | 3 | 0.16 | 12 | 5 |
| Example 10 | (2-1) | 13 | (1-63) | 19 | Compound 10 | 18 | PCZ | 47 | HOGaPC (V-Type) | 3 | 0.12 | 12 | 5 |
| Example 11 | (2-1) | 13 | (1-41) | 19 | Compound 10 | 18 | PCZ | 47 | HOGaPC (V-Type) | 3 | 0.14 | 11 | 5 |
| Example 12 | (2-1) | 13 | (1-42) | 19 | Compound 10 | 18 | PCZ | 47 | HOGaPC (V-Type) | 3 | 0.14 | 11 | 5 |
| Example 13 | (2-1) | 13 | (1-21) | 19 | Compound 10 | 18 | PCZ | 47 | HOGaPC (V-Type) | 3 | 0.15 | 12 | 5 |
| Example 14 | (2-1) | 13 | (1-22) | 19 | Compound 10 | 18 | PCZ | 47 | HOGaPC (V-Type) | 3 | 0.15 | 12 | 5 |
| Example 15 | (2-1) | 13 | (1-1) | 19 | Compound 10 | 18 | PCZ | 47 | ClGaPC | 3 | 0.16 | 16 | 4 |
| Example 16 | (2-2) | 13 | (1-1) | 19 | Compound 10 | 18 | PCZ | 47 | ClGaPC | 3 | 0.16 | 16 | 4 |
| Example 17 | (2-3) | 13 | (1-1) | 19 | Compound 10 | 18 | PCZ | 47 | ClGaPC | 3 | 0.17 | 17 | 4 |
| Example 18 | (2-3) | 13 | (1-1) | 19 | Compound 10 | 18 | PCZ-BP | 47 | HOGaPC (V-Type) | 3 | 0.13 | 18 | 3 |
| Example 19 | (2-1) | 13 | (1-1) | 19 | Compound 2 | 18 | PCZ | 47 | HOGaPC (V-Type) | 3 | 0.12 | 16 | 4 |
| Example 20 | (2-1) | 13 | (1-61) | 19 | Compound 9 | 18 | PCZ | 47 | HOGaPC (V-Type) | 3 | 0.13 | 17 | 4 |

TABLE 2

| | Electron Transport Material | | Hole Transport Material | | | | Binder Resin | | Charge Generation Material | | Evaluation | | |
|---|---|---|---|---|---|---|---|---|---|---|---|---|---|
| | Kind | Part | Kind | Part | Kind | Part | Kind | Part | Kind | Part | Sensitivity (Half-Decay Exposure μJ/cm$^2$) | Dispersibility (Ratio of Coarse Particles) | Image Quality (Point Defects) |
| Example 21 | (2-1) | 13 | (1-10) | 19 | Compound 5 | 18 | PCZ | 47 | HOGaPC (V-Type) | 3 | 0.13 | 17 | 4 |
| Example 22 | (2-2) | 13 | (1-1) | 19 | Compound 10 | 18 | PCC-BP | 47 | HOGaPC (V-Type) | 3 | 0.13 | 14 | 5 |
| Example 23 | (2-2) | 13 | (1-1) | 19 | Compound 10 | 18 | PCZ | 47 | HOGaPC (V-Type)/ ClGaPC = 5/5 | 3 | 0.14 | 14 | 5 |
| Example 24 | (2-1) | 13 | (1-64) | 19 | Compound 10 | 18 | PCZ | 47 | HOGaPC (V-Type) | 3 | 0.12 | 11 | 5 |
| Example 25 | (2-5) | 13 | (1-1) | 19 | Compound 10 | 18 | PCZ | 47 | HOGaPC (V-Type) | 3 | 0.12 | 12 | 5 |
| Example 26 | (2-6) | 13 | (1-1) | 19 | Compound 10 | 18 | PCZ | 47 | HOGaPC (V-Type) | 3 | 0.12 | 12 | 5 |
| Example 27 | (2-7) | 13 | (1-1) | 19 | Compound 10 | 18 | PCZ | 47 | HOGaPC (V-Type) | 3 | 0.12 | 12 | 5 |
| Example 28 | (2-8) | 13 | (1-1) | 19 | Compound 10 | 18 | PCZ | 47 | HOGaPC (V-Type) | 3 | 0.12 | 12 | 5 |
| Example 29 | (2-9) | 13 | (1-1) | 19 | Compound 10 | 18 | PCZ | 47 | HOGaPC (V-Type) | 3 | 0.14 | 12 | 5 |
| Example 30 | (2-10) | 13 | (1-1) | 19 | Compound 10 | 18 | PCZ | 47 | HOGaPC (V-Type) | 3 | 0.14 | 12 | 5 |
| Example 31 | (2-2) | 13 | (1-1) | 19 | Compound 10 | 18 | PCZ | 47 | HOGaPC (II-Type) | 3 | 0.19 | 16 | 4 |
| Example 32 | (2-2) | 25 | (1-1) | 13 | Compound 10 | 12 | PCZ | 47 | HOGaPC (V-Type) | 3 | 0.16 | 14 | 5 |
| Example 33 | (2-2) | 20 | (1-1) | 15 | Compound 10 | 15 | PCZ | 47 | HOGaPC (V-Type) | 3 | 0.14 | 14 | 5 |
| Example 34 | (2-2) | 10 | (1-1) | 20 | Compound 10 | 20 | PCZ | 47 | HOGaPC (V-Type) | 3 | 0.14 | 14 | 5 |
| Example 35 | (2-2) | 5 | (1-1) | 23 | Compound 10 | 22 | PCZ | 47 | HOGaPC (V-Type) | 3 | 0.18 | 14 | 5 |
| Example 36 | (2-1) | 13 | (1-1) | 37 | — | 0 | PCZ | 47 | HOGaPC (V-Type) | 3 | 0.13 | 11 | 5 |
| Example 37 | (2-1) | 13 | (1-1) | 37 | — | 0 | PCZ | 47 | HOGaPC (V-Type) | 3 | 0.13 | 11 | 5 |

TABLE 3

| | Electron Transport Material | | Hole Transport Material | | | | Binder Resin | | Charge Generation Material | | Evaluation | | |
|---|---|---|---|---|---|---|---|---|---|---|---|---|---|
| | Kind | Part | Kind | Part | Kind | Part | Kind | Part | Kind | Part | Sensitivity (Half-Decay Exposure μJ/cm$^2$) | Dispersibility (Ratio of Coarse Particles) | Image Quality (Point Defects) |
| Comparative Example 1 | (2-1) | 13 | Compound 10 | 37 | — | 0 | PCZ | 47 | HOGaPC (V-Type) | 3 | 0.24 | 12 | 5 |
| Comparative Example 2 | (2-2) | 13 | Compound 2 | 37 | — | 0 | PCZ | 47 | HOGaPC (V-Type) | 3 | 0.23 | 16 | 4 |
| Comparative Example 3 | (2-3) | 13 | Compound 9 | 37 | — | 0 | PCZ | 47 | HOGaPC (V-Type) | 3 | 0.23 | 17 | 4 |
| Comparative Example 4 | (2-4) | 13 | Compound 5 | 37 | — | 0 | PCZ | 47 | HOGaPC (V-Type) | 3 | 0.25 | 17 | 4 |
| Comparative Example 5 | Compound 1 | 13 | (1-41) | 19 | Compound 10 | 18 | PCZ | 47 | HOGaPC (V-Type) | 3 | 0.16 | 25 | 1 |
| Comparative Example 6 | Compound 3 | 13 | (1-42) | 19 | Compound 10 | 18 | PCZ | 47 | HOGaPC (V-Type) | 3 | 0.16 | 24 | 1 |
| Comparative Example 7 | Compound 6 | 13 | (1-21) | 19 | Compound 10 | 18 | PCZ | 47 | HOGaPC (V-Type) | 3 | 0.15 | 25 | 1 |
| Comparative Example 8 | Compound 4 | 13 | (1-22) | 19 | Compound 10 | 18 | PCZ | 47 | HOGaPC (V-Type) | 3 | 0.17 | 25 | 1 |
| Comparative Example 9 | Compound 7 | 13 | (1-41) | 19 | Compound 10 | 18 | PCZ | 47 | HOGaPC (V-Type) | 3 | 0.16 | 22 | 2 |
| Comparative Example 10 | Compound 8 | 13 | (1-42) | 19 | Compound 10 | 18 | PCZ | 47 | HOGaPC (V-Type) | 3 | 0.16 | 23 | 2 |
| Comparative Example 11 | (2-1) | 13 | (1-21) | 19 | Compound 10 | 18 | PCZ | 47 | $H_2$PC (x-Type) | 3 | 0.32 | 27 | 1 |
| Comparative Example 12 | (2-2) | 13 | (1-22) | 19 | Compound 10 | 18 | PCZ | 47 | TiOPC (II-Type) | 3 | 0.15 | 26 | 1 |

It can be seen from the above results that, when the Examples are compared to the Comparative Examples, superior results are obtained in all of the evaluations for sensitivity of a photoreceptor, dispersibility of a charge generation material, and image quality.

Hereinafter, the abbreviations in Tables 1 to 3 are shown in detail.

Electron and Hole Transport Material (1-1), (1-2), (1-10), (1-21), (1-22), (1-41), (1-42), (1-61) to (1-64): Exemplary compound of hole transport material represented by Formula (1)

(2-1) to (2-4): Exemplary compound of electron transport material represented by Formula (2)

Compound 1: Electron transport material having the following structure

Compound 2: Hole transport material having the following structure

Compound 3: Electron transport material having the following structure

Compound 4: Electron transport material having the following structure

Compound 5: Hole transport material having the following structure

Compound 6: Electron transport material (in Formula (2), $R^{11}$ to $R^{17}$=H, $R^{18}$=n-$C_4H_9$)

Compound 7: Electron transport material (in Formula (2), $R^{11}$ to $R^{17}$=H, $R^{18}$=n-$C_{11}H_{23}$)

Compound 8: Electron transport material (in Formula (2), $R^{11}$ to $R^{17}$=H, $R^{18}$=2-ethylhexyl group (branched))

Compound 9: Hole transport material having the following structure

Compound 10: N,N'-diphenyl-N,N'-bis(3-methylphenyl)-[1,1']biphenyl-4,4'-diamine

Compound 1

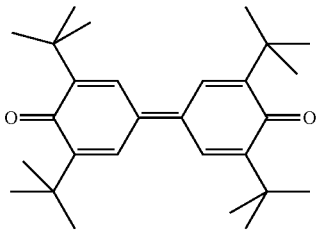

Compound 2

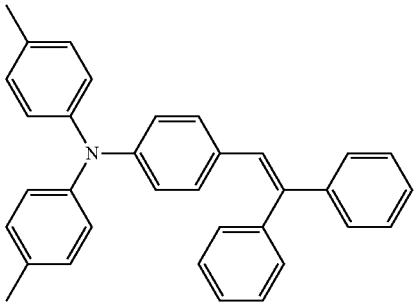

-continued

Compound 3

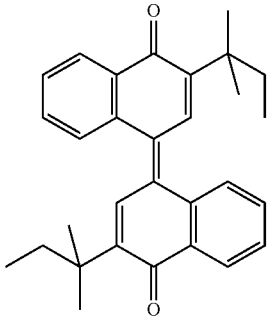

Compound 4

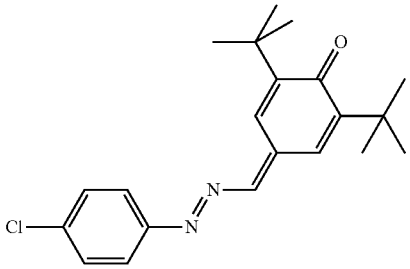

Compound 5

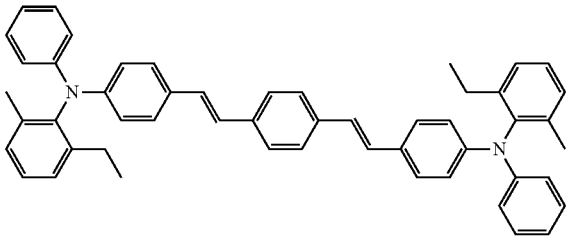

Compound 9

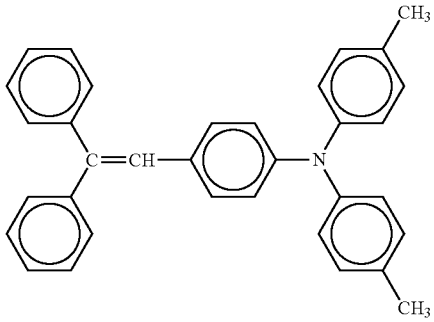

Binder Resin

PCZ: Bisphenol Z polycarbonate resin (viscosity average molecular weight: 50,000)

PCZ-BP: Copolymer having the following structure (ratio of PCZ/BP (weight ratio)=75/25, viscosity average molecular weight: 40,000)

PCC-BP: Copolymer having the following structure (ratio of PCC/BP (weight ratio)=75/25, viscosity average molecular weight: 40,000)

PCZ-BP

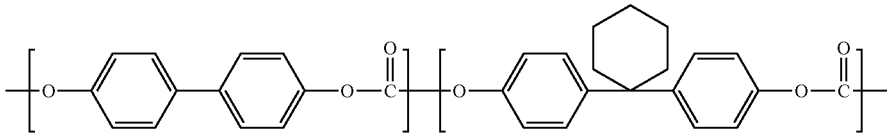

PCC-BP

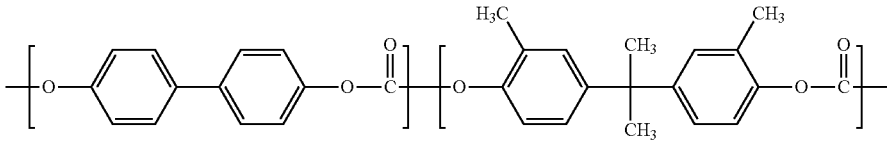

Charge Generation Material

HOGaPC (V-type): V-type hydroxygallium phthalocyanine pigment having diffraction peaks at Bragg angles (2θ±0.2°) of at least 7.3°, 16.0°, 24.9°, and 28.0° in X-ray diffraction spectrum using Cukα characteristic X-rays (maximum peak wavelength in spectral absorption spectrum of wavelength range of from 600 nm to 900 nm=820 nm, average particle diameter=0.12 μm, maximum particle diameter=0.2 μm, specific surface area=60 $m^2/g$)

HOGaPC (II-type): II-type hydroxygallium phthalocyanine pigment having diffraction peaks at Bragg angles (2θ±0.2°) of 7.7', 16.5°, 25.1°, 26.6°, and 28.5°

ClGaPC: Chlorogallium phthalocyanine pigment having diffraction peaks at Bragg angles (2θ±0.2°) of at least 7.4°, 16.6°, 25.5°, and 28.3° in X-ray diffraction spectrum using CuKα characteristic X-rays (maximum peak wavelength in spectral absorption spectrum of wavelength range of from 600 nm to 900 nm=780 nm, average particle diameter=0.15 μm, maximum particle diameter=0.2 μm, specific surface area=56 $m^2/g$)

$H_2PC$ (x-type): Metal-free phthalocyanine pigment (phthalocyanine in which two hydrogen atoms are coordinated to center of phthalocyanine skeleton)

TiOPC (II-type): Titanyl phthalocyanine pigment

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a single-layer photosensitive layer that is provided on the conductive substrate and includes a binder resin, at least one kind of charge generation material selected from hydroxygallium phthalocyanine pigments and chlorogallium phthalocyanine pigments, a hole transport material represented by Formula (1), and an electron transport material represented by Formula (2):

Formula (1)

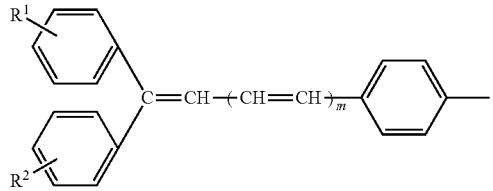

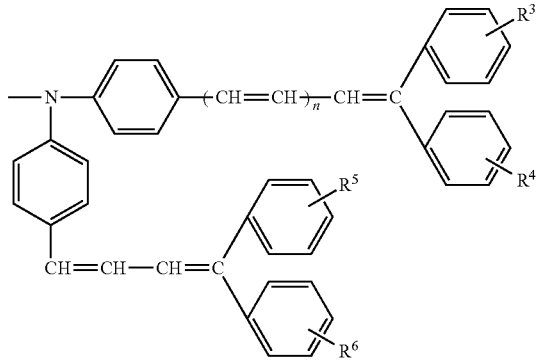

wherein in Formula (1), $R^1$, $R^2$, $R^3$, $R^4$, $R^5$, and $R^6$ each independently represent a hydrogen atom, a lower alkyl group, an alkoxy group, a phenoxy group, a halogen atom, or a phenyl group which may have a substituent selected from a lower alkyl group, an alkoxy group, and a halogen atom; and m and n each independently represent 0 or 1:

Formula (2)

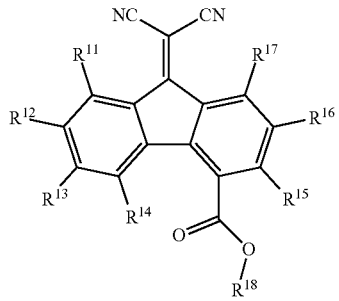

wherein in Formula (2), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, or an aryl group; and $R^{18}$ represents a linear alkyl group having from 5 to 10 carbon atoms.

2. The electrophotographic photoreceptor according to claim 1, wherein a content of the hole transport material is from 10% by weight to 98% by weight with respect to the binder resin.

3. The electrophotographic photoreceptor according to claim 1, wherein a content of the hole transport material is from 60% by weight to 95% by weight with respect to the binder resin.

4. The electrophotographic photoreceptor according to claim 1, wherein a content of the hole transport material is from 70% by weight to 90% by weight with respect to the binder resin.

5. The electrophotographic photoreceptor according to claim 1, wherein a content of the electron transport material is from 10% by weight to 70% by weight with respect to the binder resin.

6. The electrophotographic photoreceptor according to claim 1, wherein a content of the electron transport material is from 15% by weight to 50% by weight with respect to the binder resin.

7. The electrophotographic photoreceptor according to claim 1, wherein a content of the electron transport material is from 20% by weight to 40% by weight with respect to the binder resin.

8. The electrophotographic photoreceptor according to claim 1, wherein a ratio (hole transport material/electron transport material) of the hole transport material to the electron transport material is from 1 to 9.

9. The electrophotographic photoreceptor according to claim 1, wherein a ratio (hole transport material/electron transport material) of the hole transport material to the electron transport material is from 1.5 to 4.

10. The electrophotographic photoreceptor according to claim 1, wherein the charge generation material is a V-type hydroxygallium phthalocyanine pigment.

11. The electrophotographic photoreceptor according to claim 1, wherein in the hole transport material represented by Formula (1), m and n represent 1.

12. A process cartridge, which is detachable from an image forming apparatus, comprising:

the electrophotographic photoreceptor according to claim 1.

13. An image forming apparatus comprising:

the electrophotographic photoreceptor according to claim 1;

a charging unit that charges the electrophotographic photoreceptor;

an electrostatic latent image forming unit that forms an electrostatic latent image on a charged electrophotographic photoreceptor;

a developing unit that accommodates a developer containing a toner and develops the electrostatic latent image, formed on the electrophotographic photoreceptor, using the developer to form a toner image; and a transfer unit that transfers the toner image onto a transfer medium.

* * * * *